US005735492A

United States Patent [19]

Pace

[11] Patent Number: 5,735,492

[45] Date of Patent: Apr. 7, 1998

[54] RAILROAD CROSSING TRAFFIC WARNING SYSTEM APPARATUS AND METHOD THEREFORE

[76] Inventor: Joseph A. Pace, 9714 N. 72nd St., Omaha, Nebr. 68122

[21] Appl. No.: 710,147

[22] Filed: Sep. 16, 1996

Related U.S. Application Data

[63] Continuation-in-part of Ser. No. 601,902, Feb. 15, 1996, which is a continuation-in-part of Ser. No. 650,303, Feb. 4, 1991, abandoned.

[60] Provisional application No. 60/009,926, Jan. 16, 1996 and provisional application No. 60/009,837, Jan. 12, 1996.

[51] Int. Cl.[6] ..... B61L 29/32

[52] U.S. Cl. ..... 246/125; 246/294; 246/297; 246/473.1; 340/941

[58] Field of Search ..... 246/125, 126, 246/127, 293, 294, 297, 473.1, 473.3, 202, 167 A, 270 R, 292, 473, 477; 340/904, 908, 933, 941

[56] References Cited

U.S. PATENT DOCUMENTS

| | | | |
|---|---|---|---|
| 1,700,933 | 2/1929 | Gurden | 246/473.1 |
| 1,797,302 | 3/1931 | Vantassel | 246/473.1 |
| 1,809,374 | 6/1931 | Carter | 246/126 |
| 1,812,183 | 6/1931 | Vantassel et al. . | |
| 1,868,489 | 7/1932 | Barry | 246/125 |
| 1,915,696 | 6/1933 | Richterkessing et al. | 246/125 |
| 2,203,988 | 6/1940 | Griswold | 246/473.1 |
| 2,221,290 | 11/1940 | Slawson | 246/473.1 |
| 2,592,163 | 4/1952 | Madden | 246/125 |
| 3,178,683 | 4/1965 | Phelps | 246/125 |
| 3,267,281 | 8/1966 | Hopkins . | |
| 3,781,543 | 12/1973 | Staples et al. | 246/125 |
| 3,963,202 | 6/1976 | Buck | 246/125 |
| 4,108,405 | 8/1978 | Gibson | 246/125 |
| 4,122,523 | 10/1978 | Morse et al. | 246/473.2 |
| 4,449,115 | 5/1984 | Koerner | 340/941 |
| 4,613,103 | 9/1986 | Waranowitz | 246/126 |
| 4,754,272 | 6/1988 | Illenberg et al. | 246/473.3 |
| 4,895,325 | 1/1990 | LeVoir | 246/473.1 |
| 4,942,395 | 7/1990 | Ferrari et al. | 246/473.1 |
| 5,252,893 | 10/1993 | Chacham et al. . | |

FOREIGN PATENT DOCUMENTS

| | | | |
|---|---|---|---|
| 2405408 | 8/1975 | Germany | 246/167 A |
| 4005354 | 8/1991 | Germany | 246/167 A |
| 60881 | 3/1990 | Japan | 246/473.1 |
| 3-159869 | 7/1991 | Japan | 246/126 |
| 4-221271 | 8/1992 | Japan | 246/167 A |
| 92004699 | 3/1992 | WIPO | 246/167 A |

*Primary Examiner*—S. Joseph Morano
*Attorney, Agent, or Firm*—Suiter & Associates PC

[57] ABSTRACT

A railroad crossing traffic warning system for alerting a motorist approaching a railroad crossing to the presence of an oncoming train. The system comprises a series of magnetometer sensor probes buried in the right-of way adjacent to a railroad track at predetermined distances from the railroad crossing. These sensors provide a signal to a controller unit when the presence of a train is sensed. The controller unit first determines the speed at which the oncoming train is traveling and the time it will take for the train to reach the crossing and then activates an improved warning apparatus at a predetermined amount of time before the train reaches the crossing. The improved warning apparatus comprises an X-shaped railroad crossing warning sign or "crossbuck" having a plurality of light emitting diodes ("LED") or the like mounted on the across the center thereof, a plurality of strobe lights, and a train direction indicator comprising a plurality of lamps which are lighted sequentially to indicate the direction in which the oncoming train is traveling. The system may be powered by a rechargeable battery which may be recharged by a solar panel array allowing the system to be utilized at crossings located in rural areas where a source of AC electrical power is not readily available

34 Claims, 9 Drawing Sheets

RAILROAD CROSSING TRAFFIC WARNING SYSTEM APPARATUS AND METHOD THEREFORE

CROSS-REFERENCE TO RELATED APPLICATIONS

The present application is a continuation-in-part of U.S. application Ser. No. 08/601,902 filed Feb. 15, 1996 (pending), which is a continuation-in-part of U.S. application Ser. No. 07/650,303 filed Feb. 4, 1991 (abandoned). Said application Ser. No. 08/601,902 claims the benefit under 35 U.S.C. § 119 of U.S. Provisional application Ser. No. 60/009,857 filed Jan. 12, 1996.

The present application claims the benefit, under 35 U.S.C. § 119, of U.S. Provisional application Ser. No. 60/009,926 filed Jan. 16, 1996. Said Provisional application Ser. No. 60/009,926 is herein incorporated by reference in its entirety.

TECHNICAL FIELD

The present invention relates generally to traffic warning systems and more particularly to a railroad crossing traffic warning system for alerting motorists approaching a railroad grade crossing to the presence of an oncoming railroad train.

BACKGROUND OF THE INVENTION

There are over 223,000 railroad grade crossings in the United States alone. Most of these crossings, especially those in rural areas, have only warning signs to alert motorists to the danger posed by an approaching train. Typical of railroad grade crossing warning signs is the familiar X-shaped "RAILROAD CROSSING" sign or "crossbuck." Warning signs, however, only alert motorists to the presence of a railroad crossing and do not alert them to the presence of an oncoming train. Often, a motorist may fail to see an approaching train because he was distracted or because his view of the train was obstructed by environmental conditions or darkness. Consequently, collisions between trains and automobiles at railroad crossings account for thousands of accidents each year, many of which result in extensive property damage and serious injury or death to motorists.

Known to the art are active railroad crossing warning systems utilizing the railroad tracks themselves to detect an approaching train and activate warning signal apparatus such as flashing lights and bells. These systems warn motorists when a train is detected at a predetermined distance from the crossing. However, present active warning systems do no take into account the speed of the train and thus make no allowance for the time it will take the train to reach the crossing. For example, a fast moving train may reach the crossing in only a few seconds after it is detected, while a slow moving train may fail to reach the crossing until several minutes have passed. Motorists may become impatient waiting for slow moving trains to reach the crossing. Consequently, some motorists may begin to ignore the warnings and attempt to cross the tracks possibly causing an accident should a fast moving train be encountered. Further, installation of current active warning systems may require the insulation and resetting of great lengths of track. Additionally, these systems may require the installation of expensive high voltage transformers, relays, and batteries for backup systems. Unfortunately, many rural crossings are not conducive to the installation of active warning systems that requires AC electrical power and extensive grade preparation. Consequently, these crossings usually remain inadequately protected. High speed rail corridors being proposed across the United States will only exacerbate this problem. These corridors will require improved crossing warning systems to properly secure the safety of both passengers and motorists.

OBJECTS OF THE INVENTION

Therefore, it is an object of the present invention to provide an improved railroad crossing warning system for warning a motorist, pedestrian, bystander, or the like to the presence of an approaching railroad train.

It is another object of the present invention to provide an improved railroad crossing warning system suitable for operation at remote or rural railroad grade crossings where a source of AC electrical power may not be available.

It is a further object of the invention to provide an improved railroad crossing warning system that may be easily installed at existing railroad crossings without removing, replacing or interfering with the existing railroad track.

It is yet another object of the invention to provide an railroad crossing warning system having improved warning signal devices, signs and the like.

It is still another object of the present invention to provide an improved railroad crossing system wherein the warning signal device is activated at a predetermined interval of time before the train reaches the railroad crossing.

Another object of the present invention is to provide an improved railroad crossing warning system having means to detect a stopped train at a crossing so that activation of the warning signal device or sign may be continued.

It is an object of the present invention to provide a means of collecting and recording data regarding the operation of the warning system and information about the trains passing the crossing.

A further object of the present invention is to provide an improved railroad crossing system comprising a primary system and redundant backup and fail-safe systems for added reliability and safety.

It is yet a further object of the present invention to provide an improved railroad crossing warning system wherein the components are reliable, easily maintained, and protected against vandalism.

SUMMARY OF THE INVENTION

In accordance with these objects, the present invention provides a railroad crossing traffic warning system for alerting a motorist approaching a railroad crossing to the presence of an oncoming train. As used herein, "motorist" is intended to refer not only to operators and passengers of motor vehicles, but also to pedestrians, cyclists, bystander, and the like. Sensors buried adjacent to the train rails at predetermined distances from the railroad crossing detect the presence of an approaching train. A control unit, processing signals received from these sensors, determines the speed at which the train is traveling and the time required for the train to reach the crossing. At a predetermined time before the train reaches the crossing, the control unit activates warning apparatus to alert motorists to the presence of the oncoming train. The motorists may then take cautionary or evasive action.

The system also includes improved warning apparatus. The warning apparatus comprises an X-shaped railroad crossing warning sign or "crossbuck" having reflectors, reflecting paint, or the like for reflecting the headlights of an automobile, a plurality of strobe lights to enhance the motorist's awareness of the approaching train and a train direction indicator. The crossbuck may include a plurality of light emitting diodes ("LED") or the like mounted on the across the center of the crossbuck in an X-shape. The train direction indicator comprises a plurality of lamps placed adjacent to each other in a line. These lamps are lighted sequentially to indicate the direction in which the oncoming train is traveling. Further, the warning apparatus may further include an audible warning means such as a siren horn or bell to provide an audible output signal.

Crossing guard apparatus may also be provided to detect the presence of a stopped train in the railroad crossing so that activation of the warning apparatus may be continued until the train moves from the crossing. The crossing guard includes an infrared transmitter and a receiver mounted diagonally across the crossing. The transmitter transmits an infrared beam of light across the crossing to the receiver. If a train is present in the crossing the beam is interrupted and a signal is sent to the control unit.

The system may be powered by a rechargeable battery. This battery may be recharged by a solar panel array allowing the system to be deployed at crossings located in rural areas where a source of AC electrical power is not readily available.

BRIEF DESCRIPTION OF THE DRAWINGS

The numerous objects and advantages of the present invention may be better understood by those skilled in the art by reference to the accompanying figures in which.

DETAILED DESCRIPTION OF AN EXEMPLARY EMBODIMENT

Figure 1:
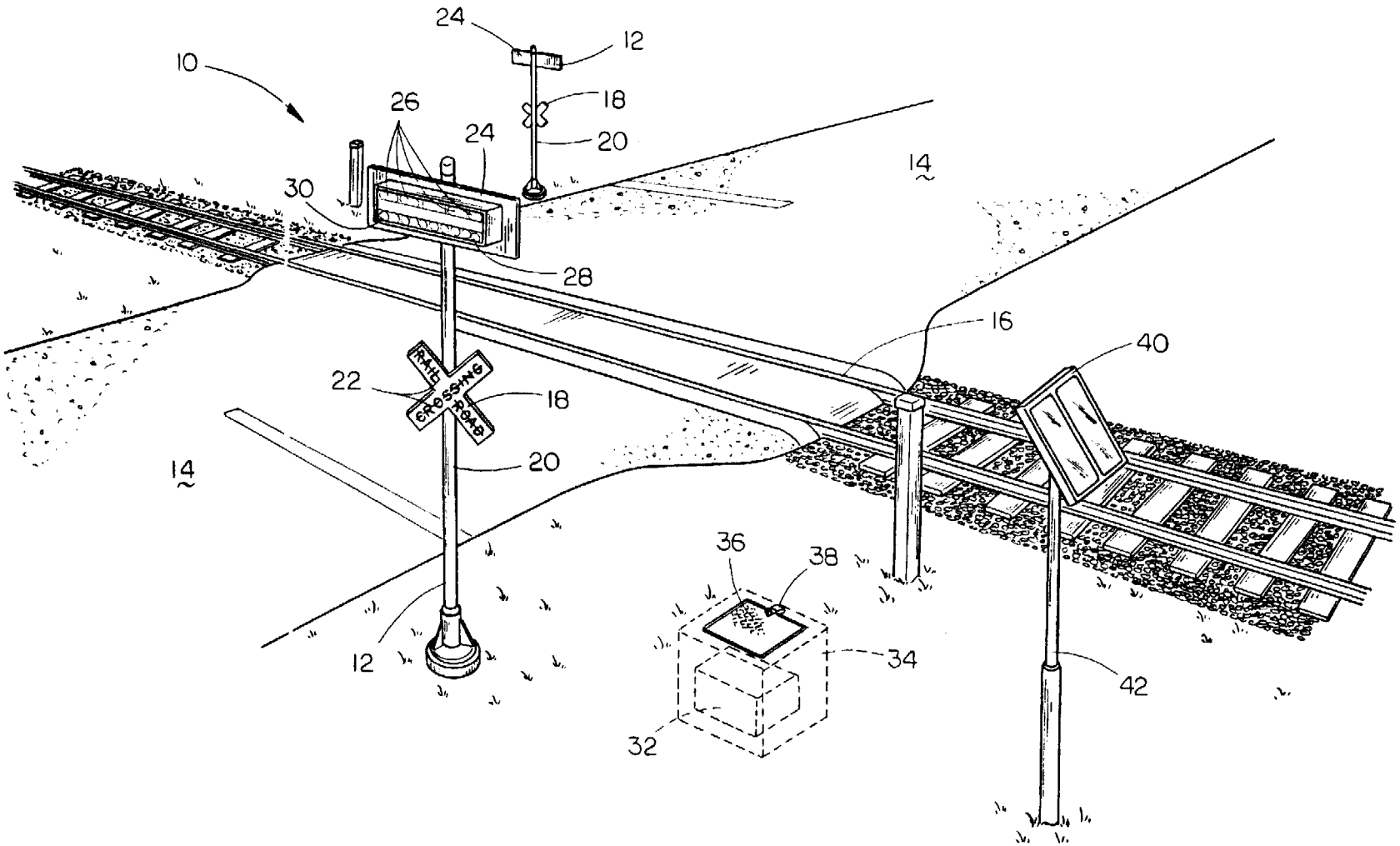
FIG. 1 is a pictorial view of a typical single track grade crossing employing a railroad crossing warning system according to an exemplary embodiment of the present invention.

FIG. 1 depicts a typical single track grade crossing employing a railroad crossing warning system 10 according to an exemplary embodiment of the present invention. The warning system 10 preferably comprises several components which operate separately of the railroad's track, equipment, or systems to provide means of actively warning a motorist, pedestrian, or the like ("motorist") approaching the crossing of the presence of an oncoming train. Warning signal devices 12 may be erected adjacent to a road or highway 14 on either side of the crossing 16. These devices 12 are preferably positioned facing oncoming traffic so as to be clearly visible to a motorist approaching the crossing on the road or highway 14. Preferably, each device 12 comprises a standard X-shaped railroad crossing warning sign or "crossbuck" 18 having reflectors, reflective paint, or the like for reflecting the lights of an approaching automobile. The crossbuck 18 may be mounted on a post, pole, mast or like supporting means 20 which is anchored in the ground next to the crossing. Visibility of the crossbuck 18 may be further enhanced by a plurality of light emitting diodes ("LED"s) 22 mounted across the center of the crossbuck 18 such that they form an X-shape. These LEDs 22 may be animated, i.e. made to flash so as to attract the motorists attention. A strobe light/train direction advisory sign 24 may be mounted above the crossbuck 18 on the mast 20. This sign 24 may include a plurality of strobe lights 26 which function to alert inattentive motorists to the presence of the approaching train. A train direction indicator 28 may also be provided comprising a plurality of lamps 30 placed adjacent to each other in a straight line. Upon detection of the presence of an approaching train by the system, these lamps 30 may be lighted sequentially in a repetitious manner to indicate the direction in which the oncoming train is traveling. Embodiments of the warning signal device 12 may further include an audible warning means such as a siren horn or bell (not shown) to provide an audible warning to the motorist.

A control unit 32 may activate the warning signal devices 12 when an approaching train is detected. The control unit 32 may be housed in a waterproof underground vault 34 located near the railroad grade crossing. The vault 34 may include a steel access door 36 secured by a locking device 38 such as a hasp to receive a padlock or the like. The buried vault 34 may provide physical security for the control unit 32 protect the control unit's electronics from the extreme temperature changes that could be experienced were the control unit 32 to be located in an above ground enclosure; which had no heating and air conditioning. Preferably, the vault 34 may be grounded to provide electrostatic shielding to the electronic components contained therein.

The system 10 is preferably powered by rechargeable batteries (not shown). The batteries may be housed within the vault 34 with the control unit 32. Recharging of the batteries may be accomplished by means of a solar panel array 40 mounted on a pole, or post 42 near the crossing. Use of solar panels 40 to recharge the system batteries is desirable when the system 10 is to be deployed at crossings located in rural areas where a source of electrical power is not readily available. The crossbuck 12, strobe light/train direction advisory sign 24, and solar panels 40 may have transparent coverings comprising ½ inch thick LEXAN® or the like to prevent damage due to the environment or vandalism.

Figure 2:
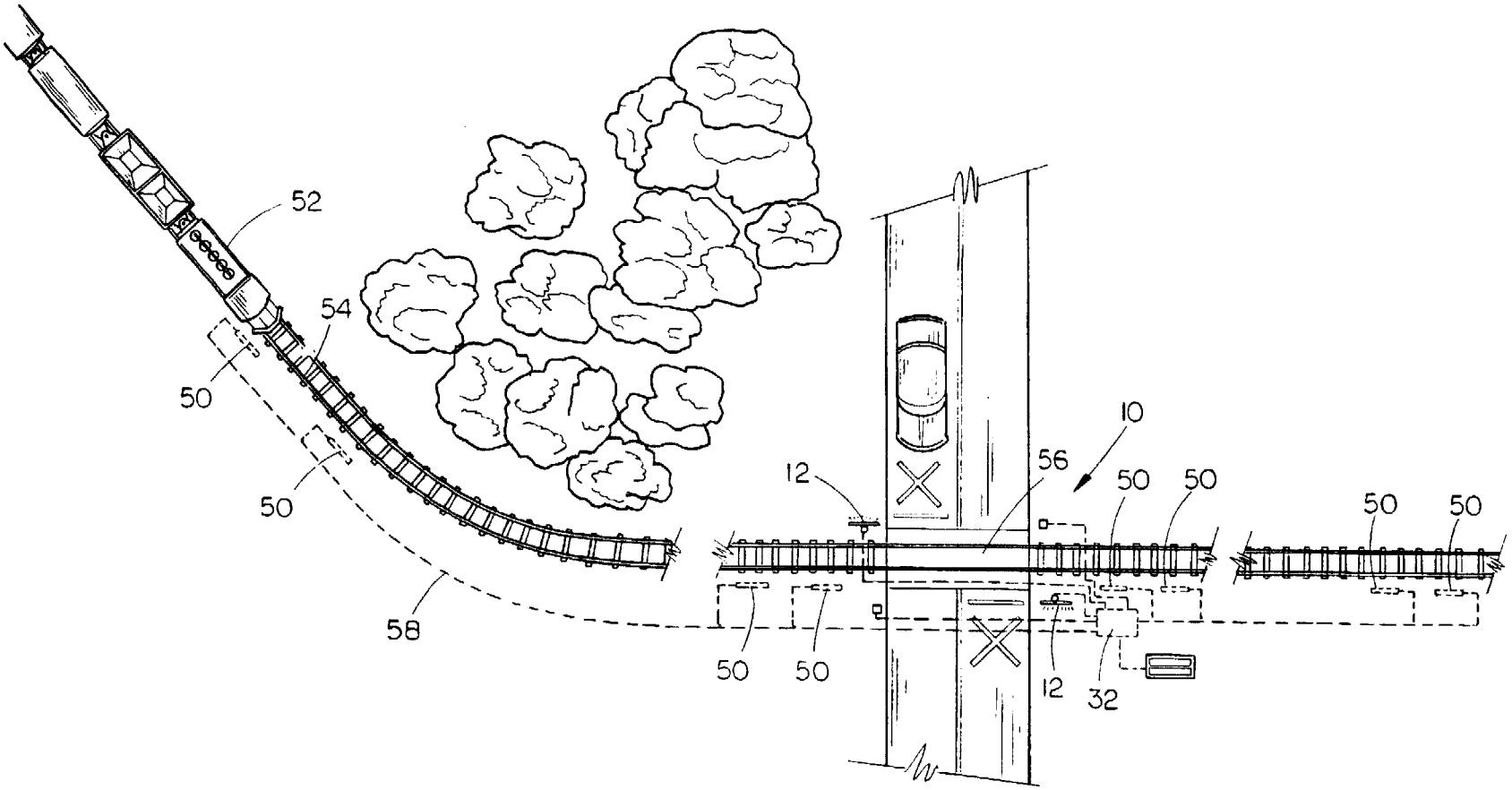
FIG. 2 is a top plan view of an area surrounding a typical grade crossing, as illustrated in FIG. 1, depicting the placement of the warning system's components along the track.

As illustrated in FIG. 2, the system 10 preferably includes a series of remote sensors probes 50 which are capable of detecting the presence of a train 52. The sensor probes 50 may be positioned adjacent to the train rails 54 at predetermined distances from the railroad crossing 56. Preferably, each sensor 50 comprises a magnetometer enclosed in a sealed housing assembly which may be buried in the right-of-way to the railroad tracks to prevent vandalism. The magnetometers produce a signal in response to local disturbances of an electromagnetic field, such as the disturbance of the magnetic field of the earth caused by the passing of a large metallic object such as a train. The sensor probes 50 may be interconnected with electronic circuitry in the control unit 32 which produces a binary (on or off) signal when the presence of a train is detected. Shielded, rodent proof, multi-conductor sealed cables 58, which may also be buried in the right-of way, may interconnect the remote sensor probes 50 to the control unit 32. These cables 58 may be further protected by electronic circuitry within the control unit 32 which monitor the integrity of a closed loop circuit in the buried cable. In the event that a cable 58 is cut or damaged, the control unit 32 will sense a break in the closed loop circuit and place the system in a fail safe mode of operation which automatically activates the warning signal devices 12.

Figure 3A:
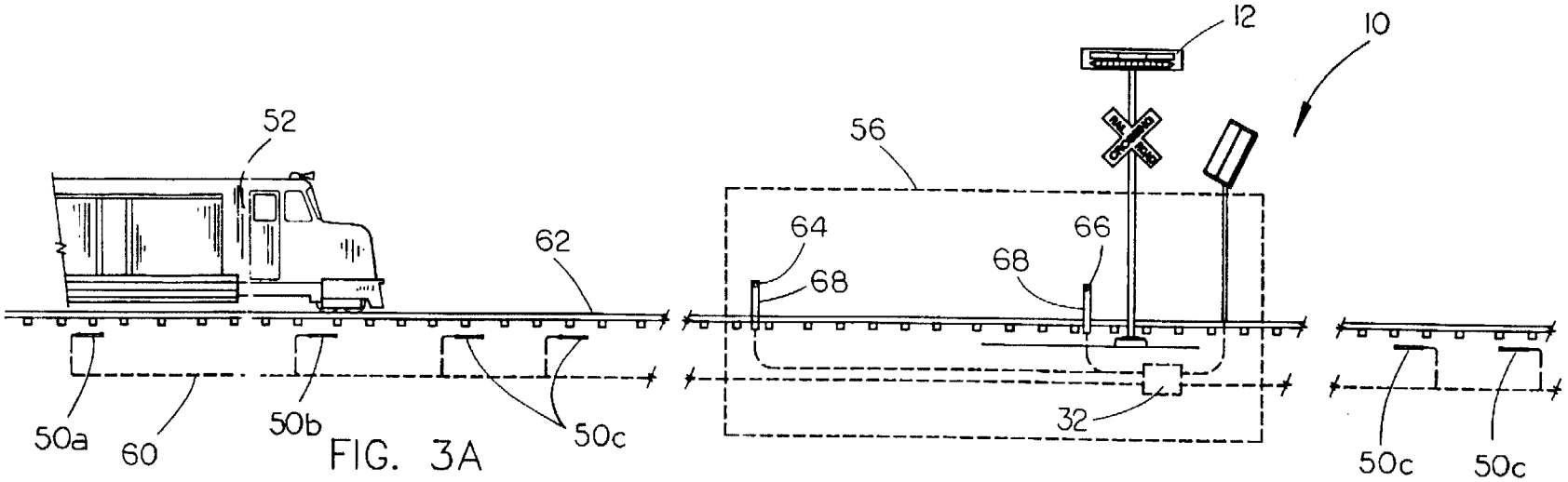
FIG. 3A is an elevational view of the embodiment of the invention shown in FIGS. 1 and 2 illustrating the operation thereof before an oncoming railroad train reaches the crossing.
Figure 3B:
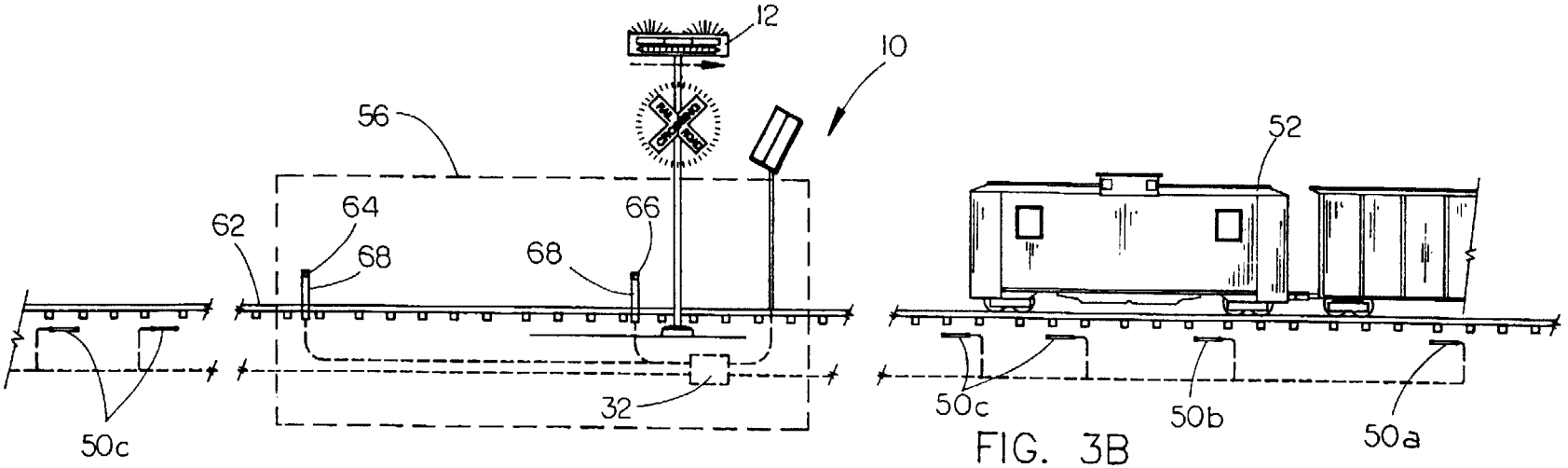
FIG. 3B is an elevational view of the embodiment of the invention shown in FIGS. 1 and 2 illustrating the operation thereof after passage of the train.

FIGS. 3A and 3B illustrate operation of the system 10 to detect an approaching train 52 and activate warning signal devices 12 located at the crossing 56. The railroad crossing warning system 10 preferably comprises a primary train detection subsystem and a secondary or backup train detection subsystem. The primary train detection subsystem may include two speed traps 60 each comprising two sensor probes 50*a* & 50*b* positioned on either side of the grade crossing 56 along the track 62 at a predetermined distance from each other. The sensor probes 50*a* & 50*b* are preferably located at a sufficient distance from the grade crossing 56 to permit the system 10 to activate the warning signal devices 12 at a predetermined interval of time before the arrival of the train 52 regardless of the train's speed. The sensor probes 50*a* & 50*b* may be buried in the earth in the right-of-way adjacent to the track 62 to prevent damage or vandalism. As a train 52 approaches the crossing 56, it passes a first primary sensor probe 50*a* positioned at a first predetermined distance from the crossing 56 and is detected. The first primary sensor probe 50*a* provides a train detection signal to the control unit 32 which is preferably located in the underground vault near the crossing 56. As the train 52 continues toward the crossing 56, it reaches a second primary sensor probe 50*b* positioned at a second predetermined distance from the crossing 56 such that its distance from the first primary sensor probe 50*a* is known. The second primary sensor probe 50*b* also detects the presence of the train 52 and sends a second train detection signal to the control unit 32. Electronic circuitry, preferably including a microprocessor, in the control unit 32 measures the time interval between receipt of the first train detection signal and receipt of the second train detection signal and using the known distance between the first and second primary sensor probes 50*a* & 50*b* calculates the speed of the train 52 and the time it will take the train 52 to reach the crossing 56.

A secondary or backup subsystem may also be provided should the primary system fail to properly detect the approaching train. Like the primary subsystem, the backup subsystem may include magnetometer sensor probes 50*c* buried in the earth in the right-of-way on either side of the grade crossing 56. Each backup sensor probe 50*c* is preferably positioned at a predetermined distance from the crossing 56 along the track 62. The backup sensor probes 50*c*, however, are placed between the second primary subsystem sensor probe 50*b* and the grade crossing 56 at a sufficient distance from the crossing to permit activation of the warning signal devices 12 before the train 52 reaches the crossing. During normal operation, the primary subsystem, upon proper detection of a train 52 by both the first and second primary sensor probes 50*a* & 50*b*, disables operation of the backup system. If, however, the primary subsystem malfunctions or the train 52 is not detected by both of the primary sensor probes 50*a* & 50*b*, the backup subsystem provides means of activating the warning signal devices 12 before the train 52 reaches the crossing 56. For example, the approaching train 52 is detected by the first primary sensor probe 50*a*. However, due to malfunction, the second primary sensor probe 50*b* fails to detect the train 52. The primary subsystem cannot determine the speed of the approaching train 52 in order to determine the appropriate time in which to activate the warning signal devices 12. Electronic circuitry, preferably including a microprocessor, within the control unit 32 does not disable the backup subsystem. As the train 52 continues toward the crossing 56, it reaches the first of the backup sensor probes 50*c* and is detected. The backup sensor probe 50*c* provides a signal to the control unit 32 which may immediately activate the warning signal devices 12.

A crossing guard subsystem may be provided comprising apparatus capable of detecting the presence of a train 52 either moving or stopped across the grade crossing 56. The crossing guard subsystem preferably allows the warning system to continue activation of the warning signal devices 12 until the train 52 clears the crossing. The crossing guard subsystem is preferably enabled when either the primary or backup subsystems detect the presence of a train 52 approaching the crossing 56. An infrared transmitter 64 and receiver 66 may be mounted on posts 68 located near the crossing 56 on either side of the track 62. Preferably, these posts 68 are positioned so that the transmitter 64 may transmit an infrared beam of light diagonally across the crossing 56 to the receiver 66. If a train 52 is present in the crossing 56 the infrared beam is interrupted and does not reach the receiver 66. The receiver 66 then may provide a signal to the control unit 32 indicating the presence of a train 52 in the crossing 56. After the train 52 has passed the crossing, the receiver 66 may provide a signal to the control unit 32 indicating that the end of the train 52 has cleared the crossing 56. The control unit 32 may then deactivate the warning signal devices 12 immediately or after a predetermined interval of time, for example 10 seconds. When no train has been detected by the warning system's primary or backup subsystems, the crossing guard subsystem is preferably disabled by the control unit 32 to avoid false activation of the warning signal devices 12 by an automobile or truck passing through the crossing.

Figure 4:
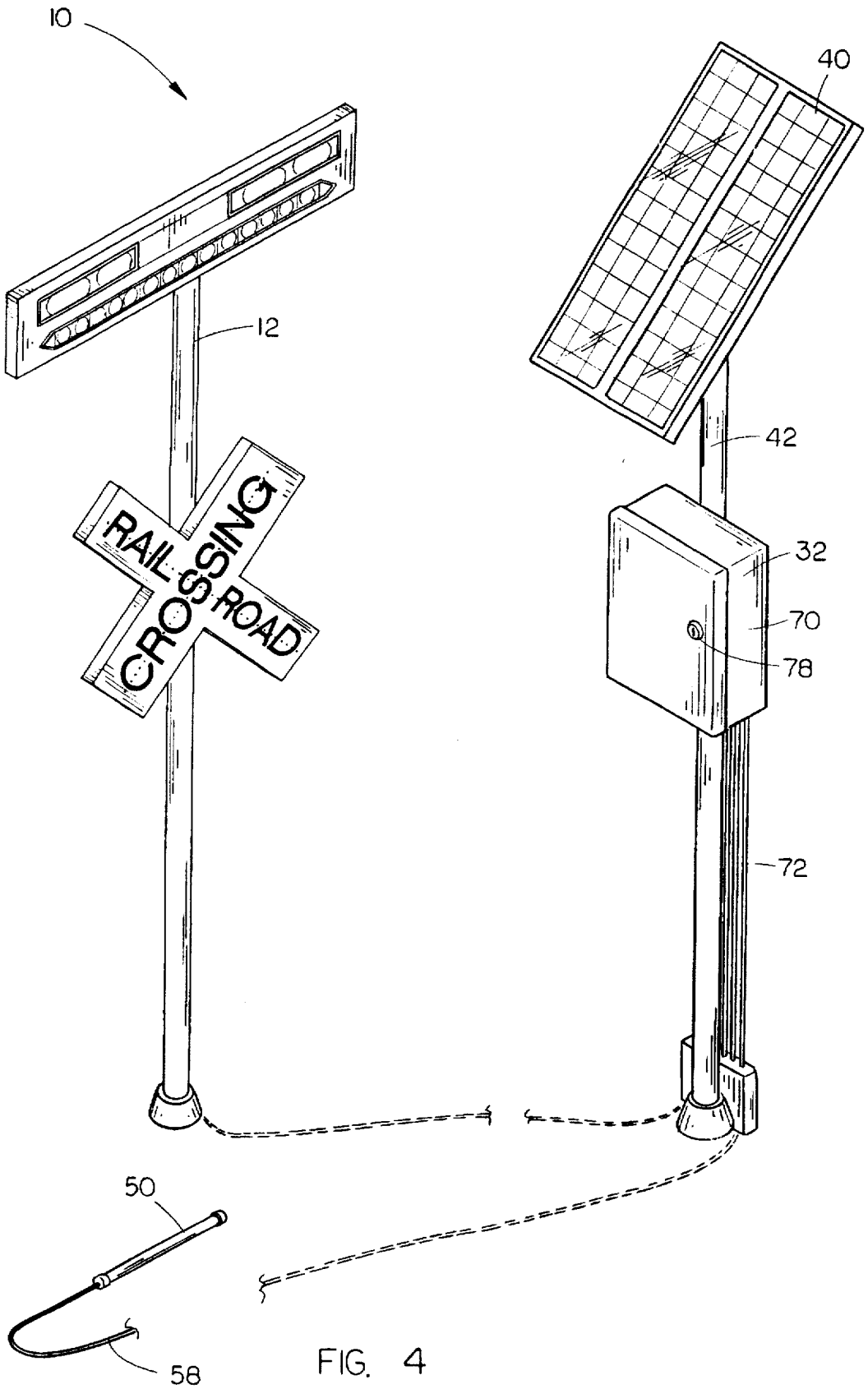
FIG. 4 is a perspective view of the basic components of the warning system according to an exemplary embodiment of the present invention.

As illustrated in FIG. 4, the warning system 10 may include several standard components which may be easily assembled together when deployed at a remote site such as a grade crossing located in a rural area. The control unit 32 may be mounted in an above-ground enclosure 70. This enclosure 70 may be made of steel and have a locking mechanism 78 to prevent vandalism. The enclosure 70 may be mounted to a mast or like support 42 which may also provide means for supporting the solar panel array 40. Cables 58 may be provided to interconnect the warning signal device 12, sensor probes 50, and control unit 32. These cables 58 may be buried in the earth adjacent to the tracks during installation of the warning system 10. Conduits 72, preferably made of steel or the like, may be provided to protect cable not buried.

Figure 5:
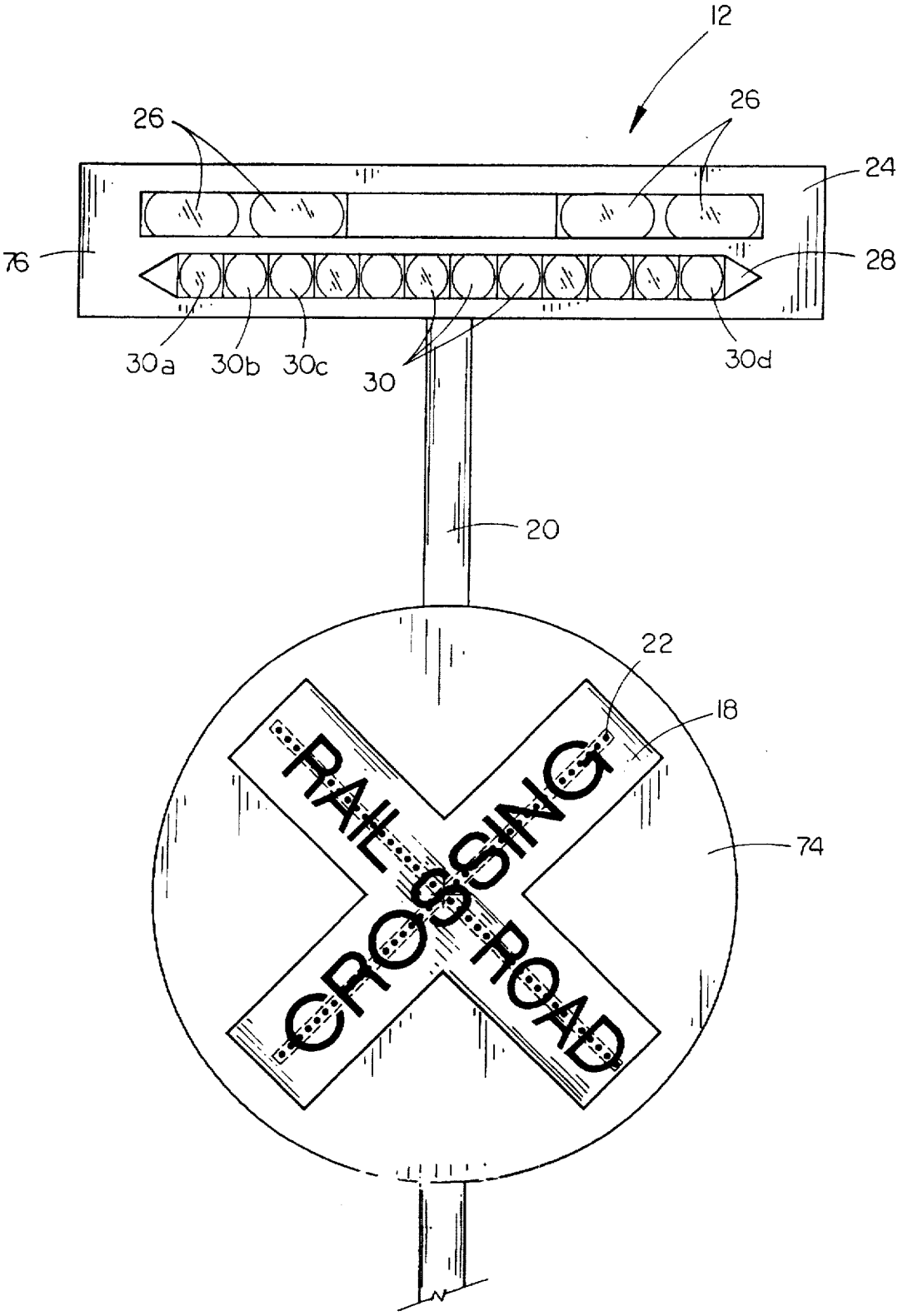
FIG. 5 is a front elevational view depicting a warning signal device according to an exemplary embodiment of the invention.

FIG. 5 depicts a railroad crossing warning signal device 12 according to an exemplary embodiment of the present invention. The warning signal device 12 preferably comprises a standard X-shaped railroad crossing warning sign or "crossbuck" 18 mounted on a post or mast 20. The surface of the cross-buck 18 preferably includes a plurality of reflectors, reflecting paint or the like for reflecting the lights of an automobile. A plurality of high intensity light emitting diodes ("LED") 22 or the like may be mounted across the center of the crossbuck 18 in an X-shape. These LEDs 22 may be animated, i.e. made to repeatedly flash on and off to attract the attention of motorists and enhance visibility of the sign at night or in poor weather conditions. Further, a shroud 74 may be mounted on the mast 20 behind the crossbuck 18 to improve the contrast between the crossbuck 18 and its background. Preferably, this shroud 74 is black. A strobe light/train direction advisory sign 24 may be mounted above the crossbuck 18 on the mast 20. Like the crossbuck 18 this sign 24 may also have a black shroud 76 to improve the contrast between it and its background. The upper half of the sign 24 may comprise an array of strobe lights 26 which when activated function to alert the motorist of an approaching train. Preferably the array comprises four strobe lights which may have an intensity of approximately 4.5 million candlepower each. The strobe lights 26 are preferably red in color and may strobe or flash at a rate of approximately 440 flashes per minute to indicate to the motorist that he must stop. The lower half of the strobe light/train direction advisory sign 24 may comprise a train direction indicator 28 which provides a means of indicating to the motorist the direction the approaching train is traveling. The train direction indicator 28 may comprise a plurality of amber colored lamps 30 placed adjacent to each other so that they form a straight line. Upon detection of the presence of an approaching train by the system, these lamps 30 may be lighted sequentially to indicate the direction in which the train is traveling. For example, if a train is approaching the crossing from the left, the left-most lamp 30*a* is lighted first, then extinguished. Immediately thereafter, the next lamp in line 30*b* is lighted and extinguished, then the next 30*c*, and so on in quick succession until the right-most lamp 30*d* is lighted then extinguished so that to a motorist viewing the sign 24, a single light appears to move from left to right. This sequence is then repeated until the train clears the crossing and the warning signal device 12 is deactivated. If a train approaches the crossing from the right, the sequence is reversed so that it would appear to a motorist viewing the sign 24 that a single light moves from right to left. Embodiments of the warning signal device 12 may further include an audible warning means such as a siren horn or bell to provide an audible output signal (not shown).

Figure 6:
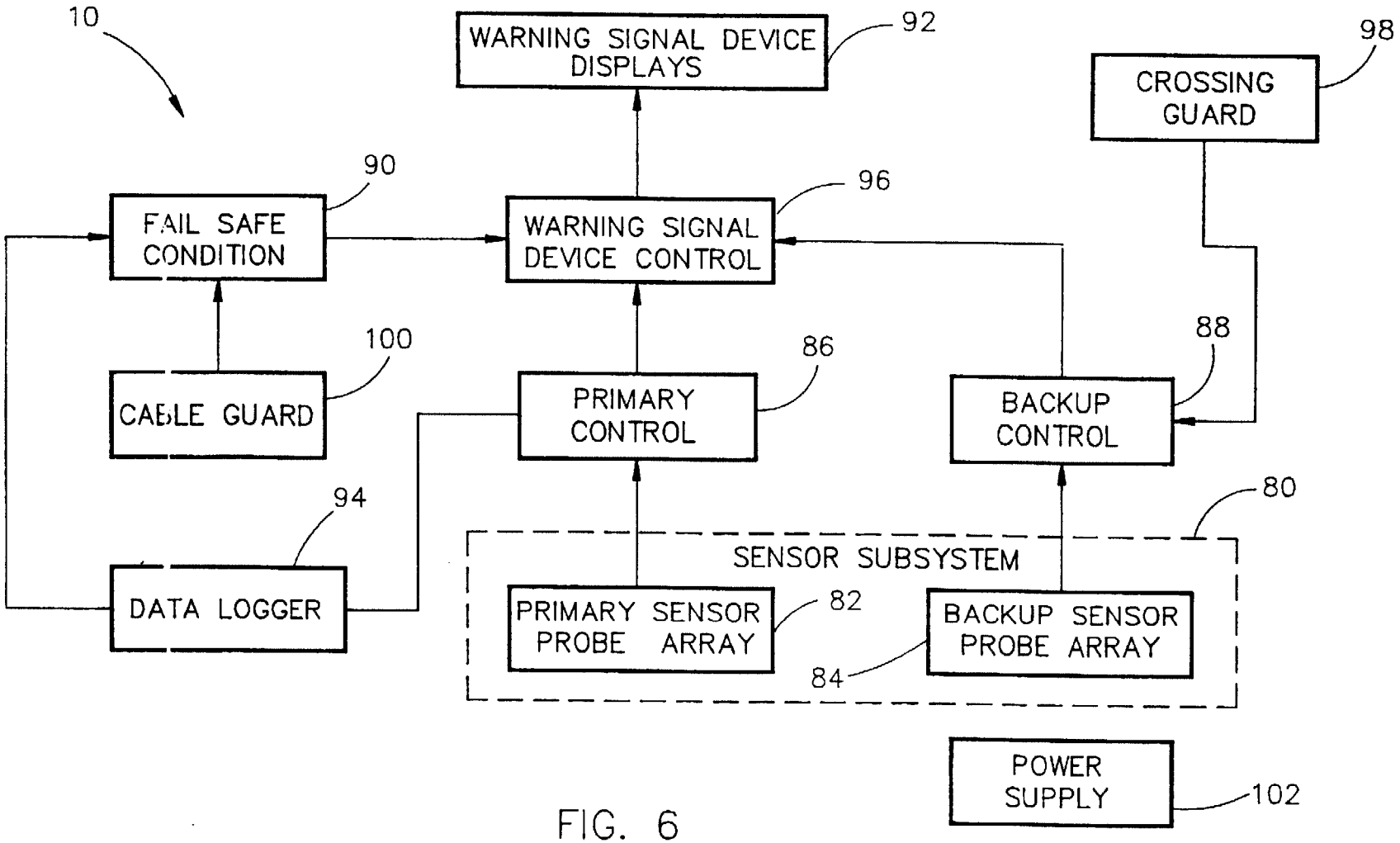
FIG. 6 is a schematic diagram of the warning system illustrating the operational features thereof.

FIG. 6 is a block diagram illustrating the interconnection of the various subsystems and components of the warning system. A sensor subsystsm 80 may comprise a primary sensor probe array 82 and a backup sensor probe array 84 each including several magnetometer sensor probes and corresponding electronic circuitry to determine when a probe has detected the presence of a train. The sensor probes of the primary sensor probe array 82 are preferably arranged to form speed traps on either side of the grade crossing. Each speed trap may comprise two sensor probes placed at a predetermined distance from each other. The backup sensor probe array 84 may comprise two backup sensor probes placed on either side of the crossing between the crossing intersection and the innermost primary sensor probe. The sensor probes are preferably sealed assemblies which may be buried in earth for their useful life. Each sensor probe may be interconnected with electronic monitoring circuitry which produces a binary (on or off) signal when the presence of a train is detected by that probe. The primary sensor probe array 82 is monitored by electronic circuitry of the primary control subsystem 86 while the backup sensor probe array 84 is monitored by electronic circuitry of the backup control subsystem 88. Both the primary and backup sensor probe array monitoring circuitry is preferably located in the control unit which may be housed an environmentally sealed equipment enclosure 70 (FIG. 4) or vault 34 (FIG. 1). The sensor subsystem 80 may comprise eight Cartel CT-6 magnetometer probe assemblies 50 (FIG. 4) which terminate into five each CT-2N circuit board subassemblies (not shown). The CT-2B control board may be modified to include the addition of a voltage spike protection zener diode across its probe input connectors (not shown). This modification may substantially reduce the vulnerability of the assembly to damage should lightning strike the immediate vicinity of a sensor probe. The CT-6 probe construction features a sheath containing an epoxy encapsulated coil of wire terminated to a shielded cable.

Interconnecting cable 58 (FIG. 4) may be provided between the sensor probes and the control unit. This cable may be a foam/skin insulated filled cable meeting REA Specification PE-89, such as CASPIC FSF manufactured by Essex Groups, Inc. of Decatur, Ill. The interconnecting cable may be buried in the earth and preferably features sheathing to provide protection against water penetration, and mechanical or rodent damage. The cable may also be shielded to reduce susceptibility to natural or manmade electromagnetic interference. Preferably, the cable is capable of supporting sensor probes located at distances of 2 or more miles from the associated control unit. However, the present invention would seldom require cable lengths longer than a half mile. (A speed trap located ½ mile from a grade crossing would allow 25 seconds of warning time for a train traveling at 72 miles per hour.) A cable monitoring or cable guard subsystem 100 (FIG. 6) may monitor the integrity of a closed loop circuit in the buried cable. In the event that the cable is cut or damaged, the cable guard subsystem 100 preferably forces the warning system 10 into a fail safe condition 90 mode of operation resulting in illumination of the warning signal device's displays 92, which include the crossbuck LEDs 22 (FIG. 5), strobe lights 26 (FIG. 5), and train direction indicator 28 (FIG. 5) and audible warning means.

The control unit preferably comprises four additional subsystems: (1) the primary control subsystem 86, (2) the backup control subsystem 88, (3) the data recording or data logger subsystem 94, and (4) the warning signal device control subsystem 96. The primary control subsystem 86 may include the speed trap sensor probe monitoring circuits and a dedicated microprocessor assembly. This subsystem monitors the speed trap sensor probes and upon detection of an approaching train, determines parameters such as the train's speed, length, and the like in order to initiate activation of the warning signal device displays 92 located at the grade crossing. Preferably, the warning signal device displays 92 are activated at a predetermined time interval before the train reaches the crossing, regardless of the train speed. The primary control subsystem 86 may also initiate deactivation of the warning signal device displays 92 when the sensor probe arrays 82 & 84 and/or crossing guard subsystem 98 sense that the end of the train has passed the grade crossing. The primary control subsystem 86 may then reset the system in preparation for another train.

The backup control subsystem 88 preferably comprises a micro controller assembly which monitors the backup sensor probe array 84. If not disabled by the primary control subsystem 86, the backup control subsystem 88 may initiate activation of the warning signal device displays 92 whenever one or more of the backup sensor probes detects a train.

Preferably, this subsystem is automatically operational in the event of a failure of the primary control subsystem 86.

The data recording or data logger subsystem 94 may comprise a micro controller subassembly including a microprocessor, date/time clock, and battery protected random access memory. This subsystem may monitor the primary control subsystem 86 and record various parameters including the speed and length of each passing train as well as the function of the system during each train passing. In addition, the data logger subsystem 94 may periodically perform diagnostic tests of the backup control subsystem 88 and backup sensor probe array 84. If the backup subsystem 88 is found faulty, the data logger subsystem 94 may place the warning system 10 into the fail-safe condition 90 mode of operation. The microprocessor assembly (not shown) may include a lithium battery or the like to maintain the date/time clock and to maintain information stored in volatile memory.

The primary control subsystem and data logger micro controller assemblies may employ 8-bit microprocessors or the like. For example, the primary control subsystem 86 may utilize an RTC 31/52 computer board assembly, manufactured by Micromint Inc. of Vernon, Conn. Similarly, the data logger subsystsm 94 may utilize a NanoLink micro controller board assembly, manufactured by Dison Technologies of Santa Barbara, Calif. Software may be employed to control the microprocessor's operation and to set operation variables. Thus, the warning system may be configured to meet the operational requirements of an individual site operational without modification to the system's hardware or physical installation.

The crossing guard subsystem 98 including the crossing guard transmitter 64 (FIGS. 3A, 3B) and receiver 66 (FIGS. 3A, 3B) may provide a signal to the control unit indicating the presence of a train in the crossing. The control unit may use this signal to continue activation of the warning signal displays 92 when a train has stopped in the crossing and thus would not otherwise be detected by the backup sensor probe array 84. The control unit may utilize this signal to verify when a train has cleared the crossing.

The warning signal device control subsystem 96 may comprise relay logic circuits switched on and off by the control unit's subsystems to provide fail safe operation of the warning signal device displays 92. All relays in the subsystem are preferably maintained in the actuated (contacts open) state at all times. All relays are preferably industrial quality electro mechanical or solid state relays.

A power supply subsystem 102 may be provided comprising one or more rechargeable batteries and recharging circuitry. This recharging circuitry may operate using conventional 120/240 VAC electrical power from a public utility or other external source. In more remote areas, a solar panel array may provide electrical power to recharge the batteries so that the system may be operated independently from outside power sources. The power supply's batteries and recharging circuitry may be mounted in the same waterproof underground equipment vault which houses the control unit.

The railroad crossing warning system 10 may provide redundant means to activate the warning device displays 92 located at the railroad grade crossing. The system preferably comprises two basic layers of protection: (1) the control subsystems and (2) the fail safe condition. The control subsystems may include two separate subsystems having electronic circuitry used to control the warning signal device displays 92: the primary control subsystem 86 and its associated primary sensor probe array 82, and the backup control subsystem 88 and its associated backup sensor probe array 84. The primary control subsystem 86 monitors the primary sensor probe array's speed traps and activates the warning signal device displays 92 whenever a sensed event (i.e. the detection of a train) is deemed a normal train passing event (i.e. the train passes through a speed trap within a defined time window). If the sensed event does not fall within "normal" train 30 passing event criteria, control of system preferably reverts to the backup control subsystem 88. If the sensed event falls within "normal" train passing event criteria, the primary control subsystem 86 may disable the backup control subsystem 88 and take control of the system. During the time that the backup control subsystem 88 is disabled, the primary control subsystem 86 may analyze the backup control subsystem 88 for proper operation. If the backup control subsystem 88 is found faulty, the primary control subsystem 86 may place the entire warning system into the fail safe mode of operation. Conversely, the purpose of the backup control subsystem 88 is to activate the warning signal device displays 92 in the event that the primary control subsystem 86 is unable to do so. Thus, redundancy is achieved by virtue of the backup subsystem's capability to protect a grade crossing should the primary control subsystem fail. Additionally, the backup control subsystem 88 may offer protection whenever unusual events (i.e. events which do not fall within "normal" train passing event criteria) are in process. Examples of unusual events include:

1. A short train passes slowly through a primary sensor probe array 82 speed trap and stops. When the train again moves, it may be detected by the backup sensor array 84 allowing the backup control subsystem 88 to activate the warning signal device displays 92.
2. A train comes to a stop while spanning the crossing. The crossing guard subsystem 98 may continue activation of the warning signal device displays 92. When the train again moves, the backup control subsystem 88 may continue activation of the warning signal device displays 92 since the primary sensor probe array 82 would not have detected the train.
3. A high railer passes through a primary sensor array speed trap in the reverse direction (i.e. it is detected by the innermost sensor probe before being detected by the outermost sensor probe). When the outermost sensor probe detects the high railer, the primary control subsystem's micro controller is alerted that an event may be in progress. The micro controller finds that the innermost sensor probe has already detected the train. Since the micro controller may require about 0.32 seconds to become fully active after being alerted that the outermost sensor probe is tripped, it determines that something has passed through the speed trap in about 0.32 seconds (in excess of 200 mph), rejects the event as being outside normal train passing event criteria, and does not disarm the backup control subsystem 88.

The second level of redundancy is provided by the fail safe condition 90. The fail safe condition 90 is the condition where a vital relay is no longer energized. Upon loss of power to the vital relay the relay contacts may close thus providing power to the warning signal device displays 92. The warning signal device displays 92 may remain illuminated until maintenance is performed on the system and the control unit circuitry is manually reset. The fail safe condition mode of operation is the final level of redundancy regarding protection of the grade crossing. The fail-safe condition may be achieved by maintaining a display relay in a contacts-open position whenever the warning signal device displays 92 are not to be illuminated. In the event of a failure of the control unit circuitry the vital relay would be de-energized and would revert to it's normally closed state. Closure of the relay connects the warning signal device displays 92 directly to battery power and the displays remain illuminated until the fault is repaired and the system is reset by maintenance personnel.

Figure 7:
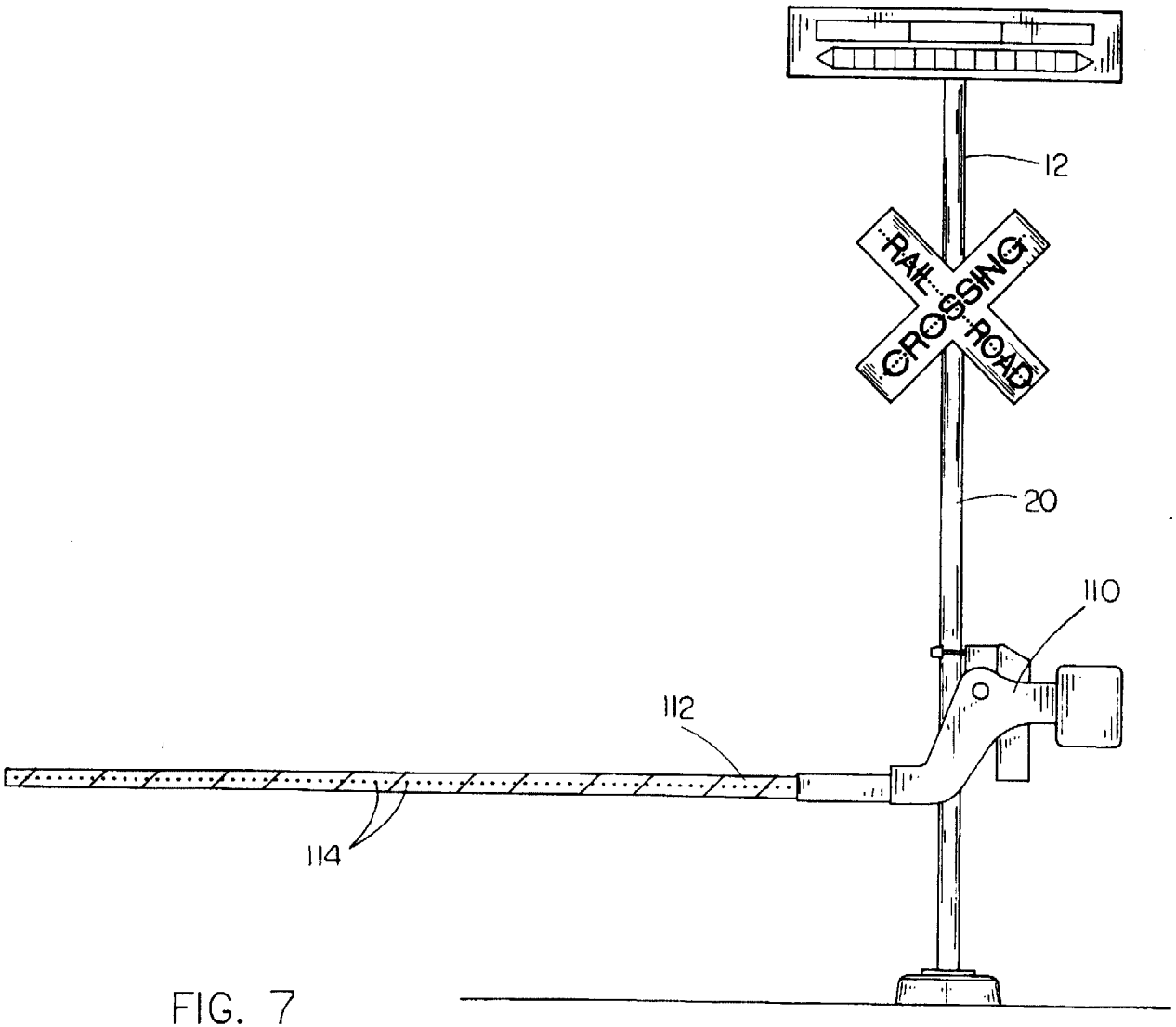
FIG. 7 is a front elevational view depicting a warning signal device according to an exemplary embodiment of the present invention employing a crossing gate.
Figure 8:
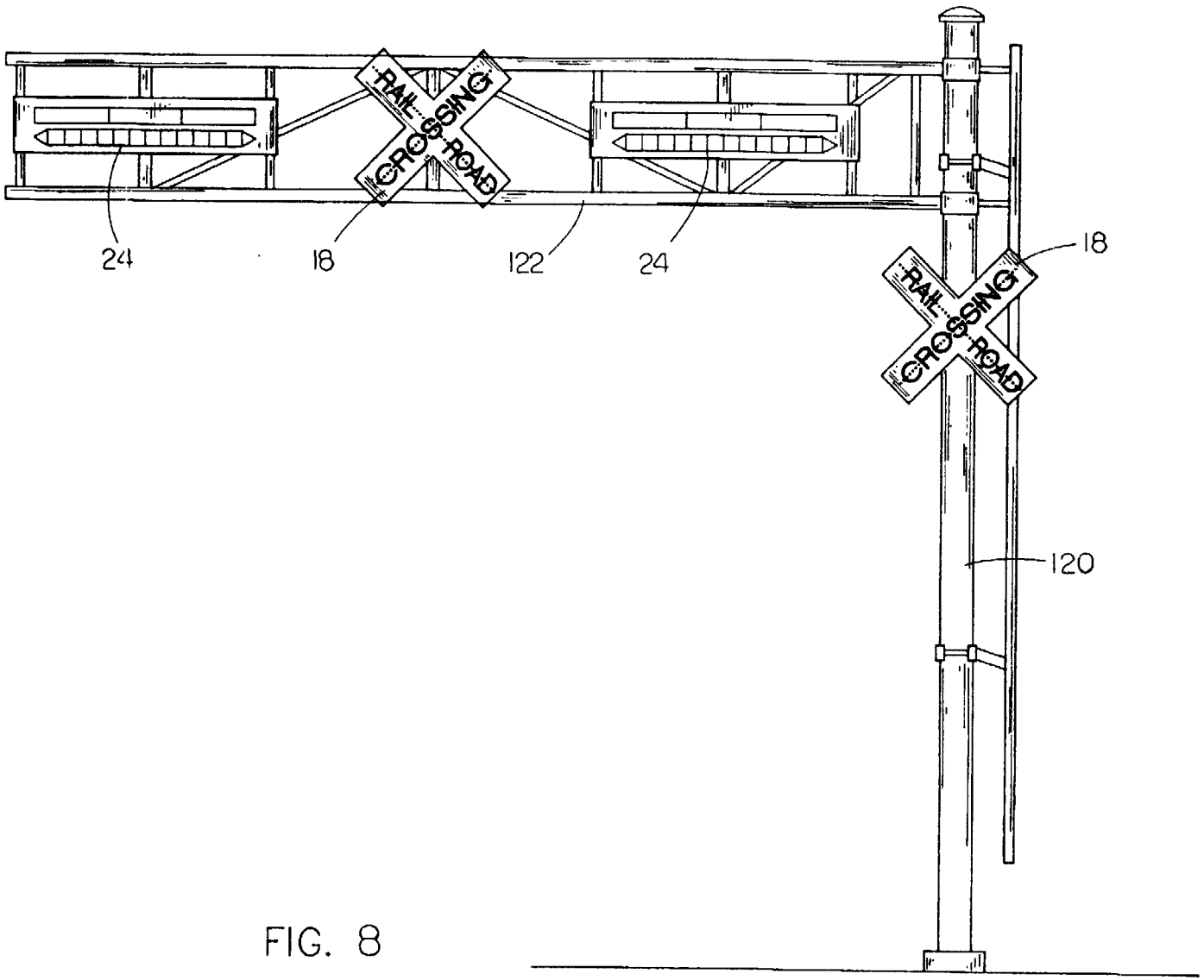
FIG. 8 is a front elevational view of a warning signal device mounted on a cantilever assembly according to alternative embodiment of the present invention.

FIGS. 7 and 8 depict alternative embodiments of the present invention wherein the warning signal device may be modified for use at grade crossings experiencing a high volume of automobile traffic. As shown in FIG. 7, the warning signal device 12 may comprise a standard crossing gate 110 to prevent motorists from entering the grade crossing when an approaching train is detected. Upon detection of an approaching train and activation of the warning signal device by the system, a cantilevered arm 112 may be lowered across the roadway at the entrance to the crossing to block automobiles from entering the crossing. After the train has cleared the crossing, the arm 112 may be raised to allow traffic to pass through the crossing. The gate 110 be mounted directly to the mast 20 of the warning signal device 12 or may itself be free standing. A plurality of lights such as LEDs 114 may be mounted along the center of the arm 112. These LEDs 114 improve the motorists ability to see the closed gate at night or in poor weather. Although a standard railroad crossing gate 110 is shown, the present invention anticipates the use of four quadrant gates and the like. FIG. 8 illustrates an alternative arrangement of the warning signs. A cantilever support structure 120 may have a cantilevered arm, truss assembly, or the like 122 which may extend over a multilane roadway. One or more animated crossbucks 18 may be mounted on this structure as required to adequately warn motorists in all lanes of traffic. Likewise, multiple strobe light/train directional indicator signs 24 may be mounted on the cantilevered arm 122 of the support structure 120 to warn the motorists in all lanes of traffic.

Figure 9:
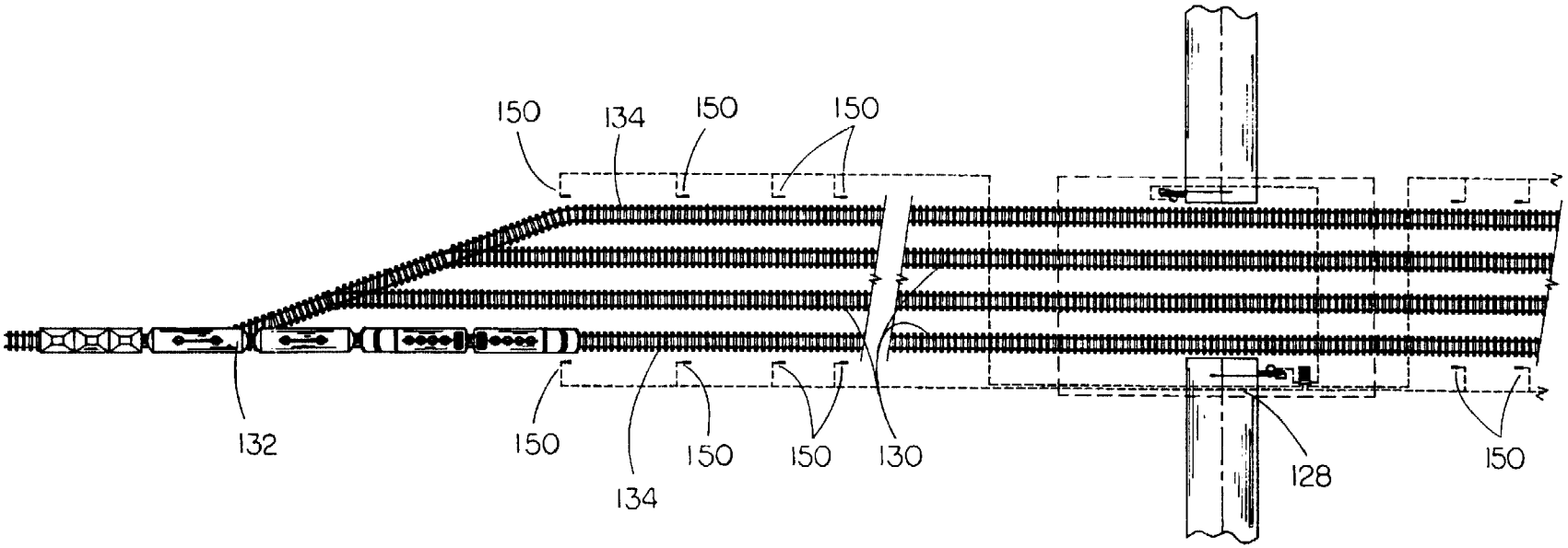
FIG. 9 illustrates the use of the present invention in a railroad crossing having multiple railroad tracks, such as in an industrial area or near a freight yard.

FIG. 9 illustrates the use of the present invention in a crossing 128 having multiple railroad tracks such as in an industrial area or near a freight yard. Sensor probes 50 may be placed at various positions on along of the tracks 130 to detect the presence of oncoming trains 132. Preferably the sensor probes 50 are buried in the right of way along the outermost train rails 134 and are capable of detecting a train moving along any of the tracks 130.

In view of the above detailed description of a preferred embodiment and modifications thereof, various other modifications will now become apparent to those skilled in the art. The claims below encompass the disclosed embodiments and all reasonable modifications and variations without departing from the spirit and scope of the invention.

What is claimed is:

1. A railroad crossing traffic warning system for alerting a motorist approaching a railroad crossing over a railroad track to the presence of an oncoming railroad train, said warning system comprising:

(a) a train detection sensor for detecting an oncoming train and for producing a train detection signal in response to the presence of an oncoming train, said train detection sensor being positioned adjacent to the railroad track at a predetermined distance from the railroad crossing;

(b) a controller unit for receiving the train detection signal from said train detection sensor, said controller unit comprising:

(i) microprocessor means for processing the train detection signal of said detection sensor, (ii) sensor signal interface means for interfacing the train detection signal of said detection sensor with said microprocessor means, (iii) means for controlling said means for alerting the motorist, said controlling means being operationally connected to said microprocessor means and to said alerting means, (iv) battery means for supplying operational power to said microprocessor means; and (c) means for alerting the motorist to the presence of an oncoming railroad train such that the motorist may take cautionary or evasive action before the arrival of an oncoming train at the railroad crossing, said alerting means being coupled to and controlled by said controller unit.

2. The railroad crossing traffic warning system of claim 1 wherein said detection sensor is a magnetometer.

3. The railroad crossing traffic warning system of claim 1 wherein said means for alerting the motorist to the presence of an oncoming railroad train comprises:

(a) support means, said support means placed at an entrance to the railroad crossing; and (b) visual warning means mounted on said support means for providing a visual output signal, said visual warning means being responsive to said controlling means.

4. The railroad crossing traffic warning system of claim 3 wherein said visual warning means comprises an X-shaped railroad crossing warning sign, said warning sign having a reflector means for reflecting the lights of an oncoming automobile and a plurality of lighting means, said plurality of lighting means forming an X-shape.

5. The railroad crossing traffic warning system of claim 4 wherein said lighting means is a light emitting diode.

6. The railroad crossing traffic warning system of claim 3 wherein said visual warning means comprises a strobe light.

7. The railroad crossing traffic warning system of claim 3 wherein said visual warning means comprises a train direction indicator means, said train direction indicator means including a plurality of lamps placed adjacent to each other in a line, said plurality of lamps lighted sequentially to indicate the direction in which an oncoming train is traveling.

8. The railroad crossing traffic warning system of claim 1 wherein said means for alerting the motorist to the presence of an oncoming railroad train comprises audible warning means mounted on said supporting means for providing an audible output signal, said audible warning means being responsive to said controller means.

9. The railroad crossing traffic warning system of claim 8 wherein said audible warning means includes a siren horn.

10. The railroad crossing traffic warning system of claim 8 wherein said audible warning means includes a bell.

11. A railroad crossing traffic warning system for alerting a motorist at a railroad crossing over a railroad track to the presence of an oncoming train, said warning system comprising:

(a) a first train detection magnetometer for detecting an oncoming train and for producing a first train detection signal in response to the presence of an oncoming train, said first train detection magnetometer being positioned adjacent to the railroad track at a first predetermined distance from the railroad crossing;

(b) a second train detection magnetometer for detecting an oncoming train and for producing a second train detection signal in response to the presence of an oncoming train, said second train detection magnetometer being positioned adjacent to the railroad track at a second predetermined distance from the railroad crossing;

(b) a controller unit for receiving said first train detection signal from said first train detection magnetometer and said second train detection signal from said second train detection magnetometer, said controller unit comprising:

(i) microprocessor means for processing the first train detection signal of said first train detection magnetometer and the second train detection signal of said second train detection magnetometer, said microprocessor means comparing said first and second train detection signals to determine a speed and which an oncoming train is traveling;

(ii) magnetometer signal interface means for interfacing the first train detection signal of said first train detection magnetometer and the second train detection signal of said second train detection magnetometer with said microprocessor means;

(ii) means for controlling said means for alerting the motorist, said controlling means being operationally connected to said microprocessor means and to said alerting means;

(iii) battery means for supplying operational power to said microprocessor means; and (c) means for alerting the motorist to the presence of an oncoming railroad train such that the motorist may take cautionary or evasive action before the arrival of an oncoming train at the railroad crossing, said alerting means being coupled to and controlled by said controller unit.

12. The railroad crossing traffic warning system of claim 11 wherein said means for alerting the motorist to the presence of an oncoming train comprises:

(a) support means, said support means placed at an entrance to the railroad crossing; and (b) visual warning means mounted on said support means for providing a visual output signal, said visual warning means being responsive to said controller means.

13. The railroad crossing traffic warning system of claim 12 wherein said visual warning means comprises an X-shaped railroad crossing warning sign, said warning sign having a reflector means for reflecting the lights of an oncoming automobile and a plurality of lighting means, said plurality of lighting means forming an X-shape.

14. The railroad crossing traffic warning system of claim 13 wherein said lighting means is a light emitting diode.

15. The railroad crossing traffic warning system of claim 12 wherein said visual warning means comprises at least one strobe light.

16. The railroad crossing traffic warning system of claim 12 wherein said visual warning means comprises a train direction indicator means, said train direction indicator means including a plurality of lamps placed adjacent to each other in a line; said plurality of lamps lighted sequentially to indicate the direction in which an oncoming train is traveling.

17. The railroad crossing traffic warning system of claim 11 further comprising a backup train detection sensor for detecting an oncoming train and for producing a backup train detection signal in response to the presence of an oncoming train, said backup train detection sensor being positioned adjacent to the railroad track at a third predetermined distance from the railroad crossing, said backup train detection signal provided to said controller unit.

18. The railroad crossing traffic warning system of claim 17 wherein said backup train detection sensor is a magnetometer.

19. The railroad crossing traffic warning system of claim 11 wherein said means for alerting the motorist to the presence of an oncoming railroad train comprises audible warning means mounted on said supporting means for providing an audible output signal, said audible warning means being responsive to said controller means.

20. The railroad crossing traffic warning system of claim 19 wherein said audible warning means includes a siren horn.

21. The railroad crossing traffic warning system of claim 19 wherein said audible warning means includes a bell.

22. A method for warming a motorist at a railroad crossing of the presence of an oncoming railroad train, said warning method comprising:

(a) detecting the presence of an oncoming train at first and second predetermined distances from the railroad crossing;

(b) determining the time required for an oncoming train to reach the railroad crossing;

(c) detecting the presence of an oncoming train at a third predetermined distance from the railroad crossing; and (d) activating means for alerting the motorist to the presence of an oncoming train when the presence of an oncoming train is detected at said third predetermined distance from the railroad crossing.

23. The warning method according to claim 22 wherein said detecting steps include detecting the presence of an approaching train with a magnetometer sensor whereby the magnetometer sensor detects variance in the magnetic field of the earth caused by the presence of a train.

24. The warning method according to claim 22 further comprising the steps of detecting when the train has passed the railroad crossing and thereafter automatically deactivating the motorist alerting means.

25. The warning method according to claim 24 wherein said detecting steps include detecting the presence of an approaching train with a magnetometer sensor whereby the magnetometer sensor detects variance in the magnetic field of the earth caused by the presence of a train.

26. An apparatus for warning a motorist at a railroad crossing of the presence of an oncoming train comprising:

(a) a support means;

(b) an X-shaped railroad crossing warning sign mounted on said support means, said warning sign having a reflector means for reflecting the lights of an oncoming automobile and a plurality of lighting means, said plurality of lighting means forming an X-shape;

(c) a strobe light;

(d) a train direction indicator means, said train direction indicator means including a plurality of lamps placed adjacent to each other in a line; said plurality of lamps lighted sequentially to indicate the direction in which an oncoming train is traveling; and (e) an audible warning means mounted on said supporting means for providing an audible output signal.

27. The of apparatus of claim 26 wherein said audible warning means includes a siren horn.

28. The apparatus of claim 26 wherein said audible warning means includes a bell.

29. The apparatus of claim 26 further comprising a shroud mounted behind said X-shaped railroad crossing warning sign.

30. The apparatus of claim 26 wherein said lighting means comprises a light emitting diode.

31. A railroad crossing traffic warning system having apparatus for detecting the presence of a train in a railroad crossing and activating a means for alerting a motorist, said apparatus comprising:

(a) a transmitter for transmitting an infrared light beam diagonally across the railroad crossing;

(b) a receiver for receiving said infrared light beam, said receiver producing a train not present signal in response to receiving said infrared light beam;

(c) a controller means, said controller means for receiving the train not present signal from said receiver.

32. A railroad crossing traffic warning system for alerting a motorist at a railroad crossing over a railroad track to the presence of an oncoming train, said warning system comprising:

(a) a first train detection sensor for detecting an oncoming train and for producing a first train detection signal in response to the presence of an oncoming train, said first train detection sensor being positioned adjacent to the railroad track at a first predetermined distance from the railroad crossing;

(b) a second train detection sensor for detecting an oncoming train and for producing a second train detection signal in response to the presence of an oncoming train, said second train detection sensor being positioned adjacent to the railroad track at a second predetermined distance from the railroad crossing;

(b) a controller unit for receiving said first train detection signal from said first train detection sensor and said second train detection signal from said second train detection sensor; and (c) a backup train detection sensor for detecting an oncoming train and for producing a backup train detection signal in response to the presence of an oncoming train, said backup train detection sensor being positioned adjacent to the railroad track at a third predetermined distance from the railroad crossing, said backup train detection signal provided to said controller unit.

33. The railroad crossing traffic warming system of claim 32 wherein said backup train detection sensor is a magnetometer.

34. The railroad crossing traffic warning system of claim 32 wherein said controller unit comprises:

(a) microprocessor means for processing the first train detection signal of said first train detection sensor, the second train detection signal of said second train detection sensor, and the backup train detection signal of said backup train detection sensor;

(b) sensor signal interface means for interfacing the first train detection signal of said first train detection sensor, the second train detection signal of said second train detection sensor, and the backup train detection signal of said backup train detection sensor with said microprocessor means;

(c) means for controlling said means for alerting the motorist, said controlling means being operationally connected to said microprocessor means and to said alerting means;

(d) battery means for supplying operational power to said microprocessor means.

* * * * *